United States Patent [19]

Hicks

[11] Patent Number: 4,508,259

[45] Date of Patent: Apr. 2, 1985

[54] VARIABLE ACCESS PARCEL AND MAIL RECEPTACLE

[76] Inventor: Robert R. Hicks, 1384 Shoop Ave, Wauseon, Ohio 43567

[21] Appl. No.: 474,880

[22] Filed: Mar. 14, 1983

[51] Int. Cl.[3] ..... B65D 91/00

[52] U.S. Cl. ..... 232/17; 232/39; 232/27

[58] Field of Search ..... 232/17, 27, 39, 20, 232/23, 38, 65

[56] References Cited

U.S. PATENT DOCUMENTS

| | | | |
|---|---|---|---|
| 697,450 | 4/1902 | Corbin | 232/17 |
| 951,090 | 3/1910 | Kilian | 232/17 |
| 2,192,445 | 3/1940 | Lau | 232/17 |
| 2,267,072 | 12/1941 | Beggs | 232/17 |
| 2,902,211 | 9/1959 | Franklin | 232/17 |
| 2,911,174 | 11/1959 | Goss | 236/39 |
| 3,106,335 | 10/1963 | Allan | 232/17 |
| 3,407,997 | 10/1968 | Wood et al. | 232/39 |
| 3,827,626 | 8/1974 | Daigle | 232/39 |
| 4,382,540 | 5/1983 | Kelly et al. | 232/17 |

*Primary Examiner*—Gene Mancene
*Assistant Examiner*—John G. Weiss
*Attorney, Agent, or Firm*—George R. Royer

[57] ABSTRACT

The subject invention is a multiple access mailbox and parcel receptacle, which comprises, in general, a longitudinally extending housing with a correspondingly internally disposed hollow chamber. Said hollow chamber conforms, in general, to the external shape of the mailbox, and there is dual entry access to this hollow chamber. First, there is a hinged door for entrance from what is considered to be front of the box, with a second access door on either the sides, back, or front of said mailbox. A spring-loaded hinge member is integrally interconnected with said second door whereby said second access door automatically swings shut after opening, and there is a one-way locking device by which arrangement such second door cannot be pushed open from the inside.

2 Claims, 8 Drawing Figures

VARIABLE ACCESS PARCEL AND MAIL RECEPTACLE

DISCUSSION OF PRIOR ART AND BACKGROUND OF INVENTION

The foremost and primary application of the subject invention is in the mailbox art. Other relevant applications would be to newspaper receptacles or parcel drop boxes, wherein the user must extract the contents after a deposit therein of specified types of articles. The invention additionally has wider application to containers used in business or other purposes for intermediate or temporary storage of items intended for later usage. In this respect, since the primary application of this invention is to the manufacture and construction of mailboxes, the following discussion will be directed mainly to this type of container, with the understanding that the background will be substantially similar for the other types of devices and that the invention has such wider applicability.

The construction and usage of mailboxes of the type used primarily in rural or suburban areas differs significantly from those used in older urban areas. In this respect, in urban areas of moderate or large-sized cities, mailboxes are usually appended directly to a dwelling, and as such they are generally offset from the road, generally distal from the roadway on which the dwelling is located. In comparison, mailboxes in rural areas and many suburban areas are usually affixed above the ground on a vertical post positioned adjacent the road. In this respect, the mailbox door, or entranceway, is universally faced towards the roadway. This latter facet enables the mailman to open the mailbox door and insert mail while in the mail delivery vehicle. Obviously, in order to comply with such latter requirement, the end of the mailbox with entrance door is usually emplaced extremely close to the edge of the roadway travelled by the mail delivery vehicle. Frequently, this roadway travelled by the mail truck is a heavily traversed thoroughfare, with vehicles passing at moderate to high speeds a relatively few feet from the mailbox entrance door. One can readily ascertain the relative danger to the postal patron by the proximity of the mailbox to the roadway traffic, in view of the fact that the user must step close to the roadway traffic in order to extract the mail from the box. The potential for vehicular-pedestrian mishaps is substantial under such circumstances, and the thread of serious injury is a very real danger. The danger lies in the fact that the patron, or any family member who seeks to obtain the mail from the mailbox, must step in front of the box to open the doorway, and pull out the mail accordingly. Such a procedure normally entails the need to stand in front of the box or close thereto. This aspect clearly presents a potential danger by reason of the close proximity.

This invention is conceived as a means to overcome the foregoing problems and devise a mailbox which avoids or alleviates, to a substantial degree, the potential for highway accidents involving persons who are extracting mail from a mailbox. The following objects of the subject invention are directed accordingly.

OBJECTS

It is an object of the subject invention to provide an improved mail or parcel receptacle;

Another object of the subject invention is to provide a mailbox which is safe to use of the type used in rural and suburban areas;

Still another object of the subject invention is to provide a mailbox which is safe to use when placing or removing the contents therefrom;

A further object of the subject invention is to provide an improved parcel receptacle;

Still another object of the subject invention is to provide an improved mailbox of the type used close to highways;

Another object of the subject invention is to provide a multiple or variable access mailbox;

Yet another object of the subject invention is to provide an improved mailbox;

An object of the subject invention is to provide a mailbox which alleviates highway safety problems;

Other and further objects of the subject invention will become apparent from a reading of the following description taken in conjunction with the drawings.

DRAWINGS

DESCRIPTION OF GENERAL EMBODIMENT

The subject invention is a mailbox, a similar parcel receptor, which is adapted to have means to avoid the necessity of having the user stand in front of the box and open the door thereof, near a roadway, in order to place therein or remove mail contents. In its most general form, the subject invention incorporates features of a secondary entranceway or doorway by which the user of the mailbox or other receptor can extract the contents, or emplace mail therein, without the need of standing in front of the doorway by the road edge. In general, the second doorway may be equipped with a spring-loaded hinge, to cause said second door to close automatically. Additionally, said second door may be equipped with latching mechanism, of variant forms, which prevents such second doorway from being pushed open from the inside, thereby preventing any mail or other materials that are emplaced in the box through the primary door from causing the secondary door to open from the inside.

Optional structural means are provided whereby the mailbox can be pivotally revolved about a vertical axis from a frontal position, through a sweep of one hundred and eighty degrees, whereby the front door portion is moved from a frontal position to a rearward, off-the-road position, for access to the mail in the interior of the box.

DESCRIPTION OF PREFERRED EMBODIMENT

Figure 1:
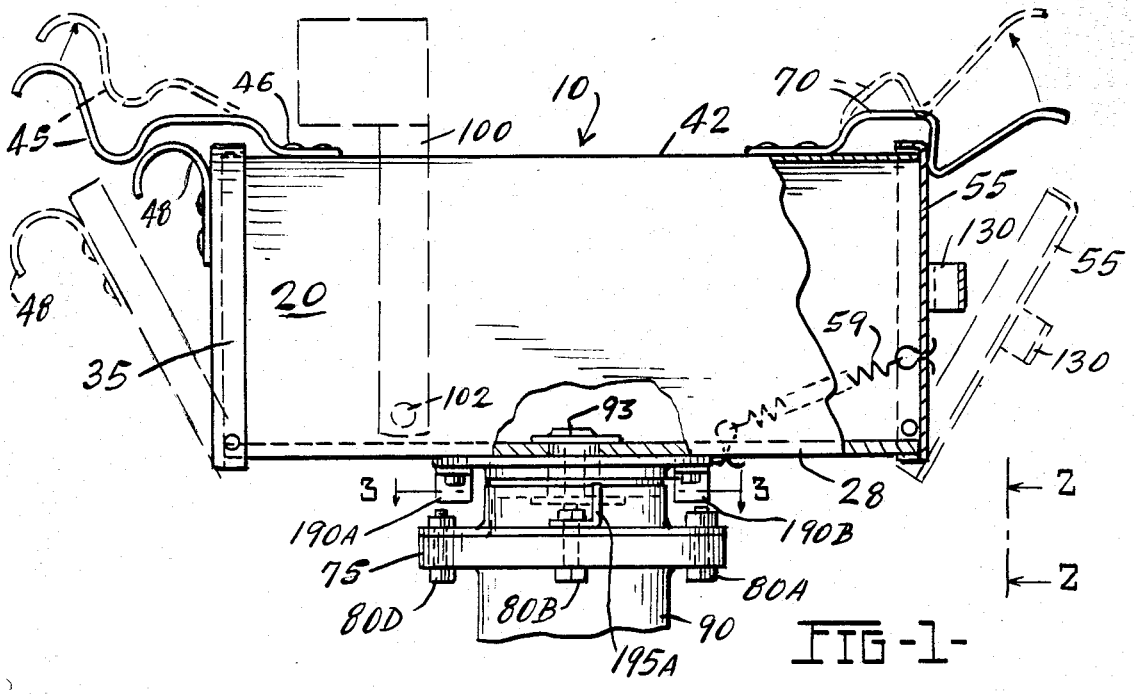
FIG. 1 is a side elevational view of the subject invention shown partially in section.
Figure 2:
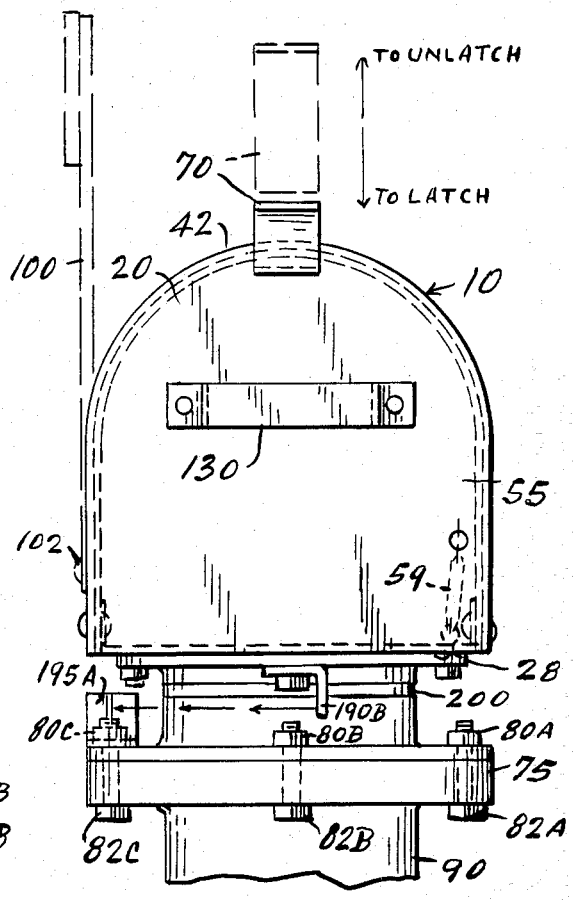
FIG. 2 is an end elevational view of the subject invention.

Referring now to the drawings in which a preferred embodiment of the subject invention is shown, and particularly to FIGS. 1 and 2. In describing the subject invention, it is to be noted that the word "frontal" will be used in reference to those portions of the mailbox which are oriented towards or facing towards the roadway, while the words "rear" or "posterior" will be used in reference to those areas of the box which are facing generally away from the roadway. Moreover, it is to be stressed that in describing the subject invention, the following description will be directed to a limited number of particular embodiments, however, such description should not be considered to limit the scope of the invention and the following claims.

In FIG. 1, the mailbox 10, as shown, possesses some of the features of the conventionally structured mailbox, as seen on rural or suburban delivery routes. In particular, mailbox 10 comprises a longitudinally extending housing member 20, the interior of which is hollow in order to receive mail or other contents therein. In general, the interior of the mailbox housing 20 is of a longitudinal disposition usually conforming to the exterior configuration of the housing 20.

The interior chamber of the box has a horizontally disposed floor 28, with a solid top 42 to cover the inside chamber to protect same from adverse climatology. Disposed on the frontal end of the box 10 is a pivotable door 35, generally representative of the downwardly swinging door type used on rural mailboxes. Door 35 is privotally mounted on its lower portion to housing 20, as shown in FIGS. 1 and 2. As shown in FIGS. 1 and 2, a door latch 45 is represented, being of the type used to lock the door 35 into the closed position by partially covering the handle 48 on door 35. In order to open the door 35, the user pulls on the door handle 48 in a frontal motion with sufficient force to overcome the spring-locking action of latching mechanism 45. This feature is a typical arrangement for such mailbox doors, however, it is to be indicated at this point that the precise structural arrangement for doorway 35, handle 48, and locking mechanism 45 are only representative, and that other structural variations may be used in this respect.

Disposed on the rear position of the mailbox shown in FIG. 1, is a rearwardly facing doorway 55, pivotally mounted to the rear of mailbox 10, as shown in FIG. 1. Such rearwardly facing doorway 55 is constructed with the following features in order to prevent its being inadvertently opened whenever mail or other objects are being placed in the interior of box 10 through the entrance of frontal doorway 35. In particular, there is a tension spring member 59 affixed on its one end to the floor 28 of the interior of housing 10, and appended on its other end to the inside wall of door 55, as shown. The use or precise positioning of the spring member 59 is optional, as it creates an optimal tensioned bias against the opening of door 55, as can be perceived from a view of FIG. 1. Additionally, a locking mechanism in the form of a spring biased clip 70 is affixed, as shown to the upper surface 42 of housing 20, as shown. This clip 70 is provided with a U-shaped bend in its middle portion, a portion of which bend depends vertically downwardly, to cover a portion of the upper part of door 55, as shown. This enables the rear door 55 to be locked, when not being held open, and the user simply must pull the extreme end of the locking clip 70 upwardly to the position shown in phantom in FIG. 1 to unlock the door. Thereupon, the user grasps the handle 130 to door 55 and pulls same outwardly in the pivotally movement and ultimate position shown in FIG. 1.

A signal flag 100, is appended to the side of the mailbox housing as shown in FIG. 1, and is pivoted at point 102, as shown in the drawings. This feature enables the mailbox user to signal to the mailman whenever mail is emplaced in the box.

In FIG. 1, the embodiment shown incorporates structural means whereby the mailbox 10 can be rotated one hundred and eighty degrees from the frontal position shown to a rearward position. In effect, such rotation allows the front portion of the box to be faced rearwardly so that the postal patron need only rotate the box to gain access therein from such rearward or posterior position. Use of such rotational structural mechanism would obviate the need for a second or rearward doorway 55, or one may use the combined apparatus of the rear doorway 55 in conjunction with the swivel apparatus, as described immediately hereinbelow.

Figure 3:
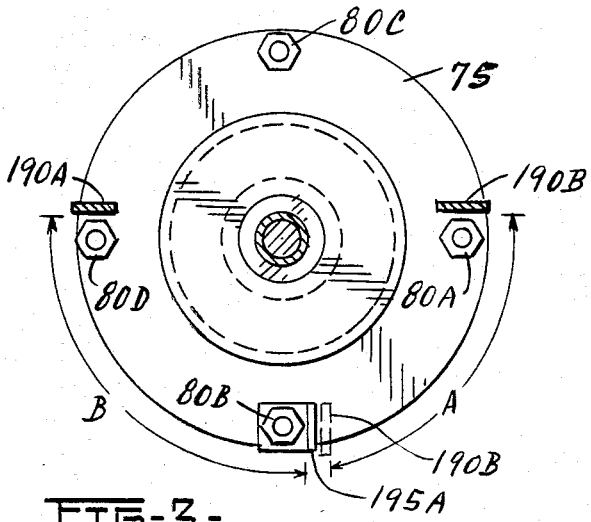
FIG. 3 is a top elevational view of the swivel post on which the mailbox in FIG. 1 is mounted as shown.

As shown in FIGS. 1, 2, and 3, the mailbox 10 is affixed on a vertical post 90 of generally cylindrical configuration. As seen specifically in FIG. 1, a pivot member 93 is affixed on the upper part of the post 90 by which arrangement the pivot member 93 projects upwardly into the inside of box 10, as shown. Mailbox 10 can thus pivot in a sweeping, circumferential movement about the post 90. In one embodiment, the post 90 has a circular plate 75 integrally affixed in a concentrix manner at or near the tope of the post 90, as shown. In this particular embodiment, the plate 75 has a slightly layer diameter than that of the post 90.

In the particular embodiment shown in FIGS. 1, 2, and 3, the plate 75 is comprised of two separate circular members juxtaposed concentrically and congruently together. In this structural arrangement the lower plate is an integral extension of the post itself, being preferably formed of one piece with the post, as represented. The upper plate portion is thus bolted to the lower plate through a series of bolts 82A, 82B, 82C and 82D, which are, in turn, locked by nut members 80A, 80B, 80C and 80D respectively. Extending vertically downwardly from the bottom surface of box 10 are rectangularly-shaped stop members 190A and 190B. These stop members 190A and 190B can be affixed at appropriate locations on the lower surface of plate 75 in order to check the circumferential swing of box 10 by engagement of a mating tang 195A affixed on the upper surface of plate 75, as shown. Most optimally, in this latter regard, is a limit of movement to one hundred and eighty degrees movement over a left or right arc. This feature prevents the box from moving freely through a complete circumferential sweep and thus limits the movement of the box to just the desired sweep as indicated.

Figure 4:
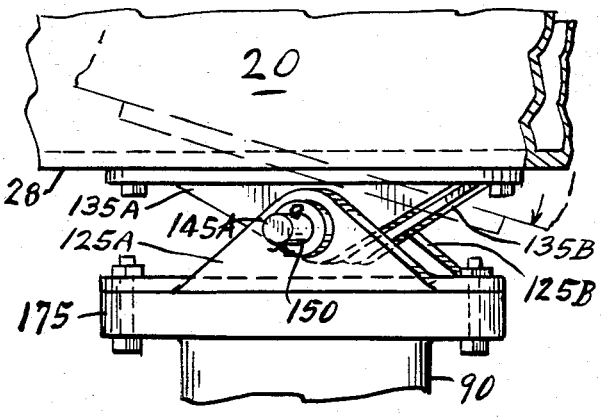
FIG. 4 is a perspective view of an alternate embodiment for the mounting post for the subject invention.

Reference is now directed to FIG. 4 in which an alternate embodiment of the subject invention is shown. In this latter embodiment, a mechanism is provided whereby the housing 20 for mailbox 10 can tilt downwardly or upwardly a minimal distance to enable either the mailman or the patron to reach the box contents. This feature provides a method by which the mailman has easier access to the box while seated in an automobile and alternately provides improved access for one who is either too short or too tall to reach into the box with any degree of facility. In this respect, the upper plate 175 on post 90 is provided with a pair of integrally appended flange extension members 125A and 125B, both of triangular configuration, with the peaks thereof extending upwardly, as shown in FIG. 4. Each such extension member 125A and 125B has circular bore 145A and 145B transversely extending therethrough, with such bores being coaxially aligned. Bore 145B cannot be seen in FIG. 4, however, its disposition and structure is identical to that of bore 145A shown in the drawings. Depending vertically downwardly from the undersurface of the mailbox 10 are two parallel mating flanges 135A and 135B which flange members are disposed closer together than are flange extension members 125A and 125B. Flanges 135A and 135B have identical transverse bores, not shown, which are coaxially aligned. Moreover, downwardly depending flanges 135A and 135B are positioned downwardly between upwardly extending flanges 125A and 125B, as shown in the drawings, so that bores 145A and 145B are aligned coaxially with the bores in flange extension members 135A and 135B. Once the latter four bores are so aligned, a circular retaining shaft 150, as shown, which shaft is appropriately locked in position. By this latter structural arrangement, the housing 20 can tilt up or down a limited distance, with such degree of tilt being limited by the presence of plate 175 vis-a-vis the position of the lower surface of housing 20, as seen in FIG. 4.

Figure 5:
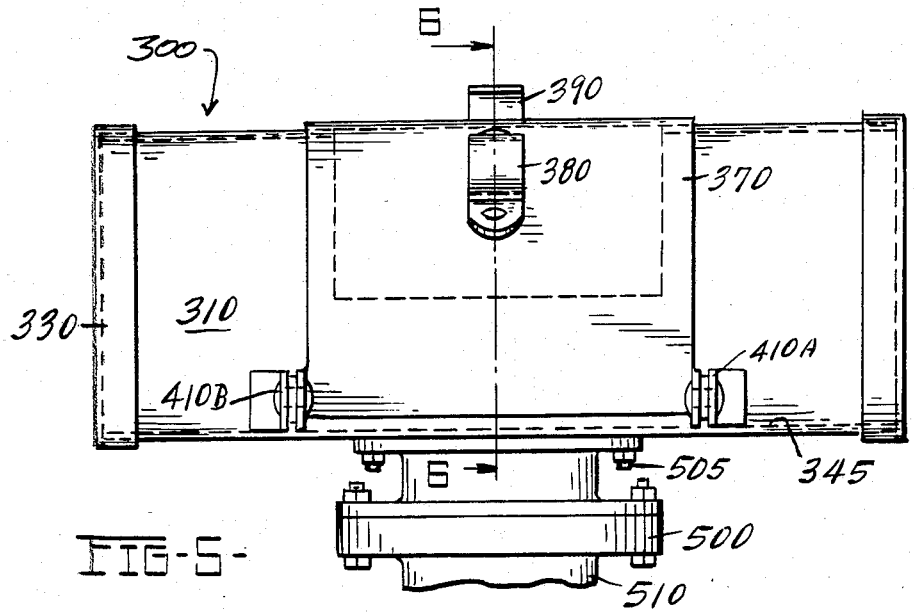
FIG. 5 is a side elevational view of an alternate embodiment for the subject invention.
Figure 6:
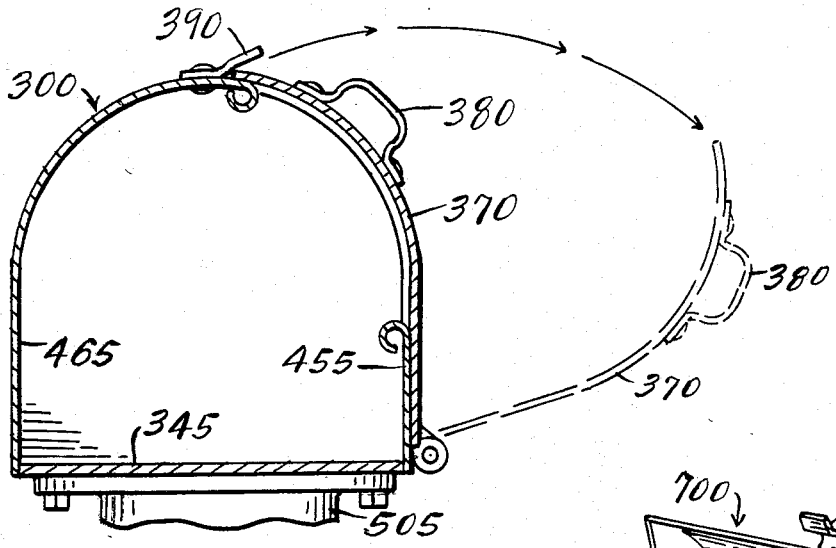
FIG. 6 is an end elevational view of the embodiment of the subject invention shown in FIG. 5.

Attention is addressed now to FIGS. 5 and 6 in which embodiment is shown an alternate arrangement for an additional door on the mailbox 300 shown therein. More specifically, in the mailbox shown, in FIGS. 5 and 6, this particular variation of the general invention is embodied in a mailbox having a housing 310 with a standard front door 330. Pivotally affixed to the side of housing 310 is a side entranceway door 370 which supplements the front door 330 for the purposes and reasons discussed hereinbelow. Specifically, such side door 370 is pivotally mounted on brackets 410A and 410B integrally appended to the lower side of housing 310, as shown. The side door 370 is conformingly shaped to contour of the adjoining side of the mailbox housing 310, as specifically shown in FIG. 6. As shown, the side door 370 can pivot outwardly away from the side of box 300 to the position shown in phantom in FIG. 6. A suitable handle member 380 is provided at the top of door 380 for necessary grasping purposes. A spring clip 390 is provided to retain the door 370 in place in the closed position, the retaining force of which is overcome by a sufficient outwardly directed pull to open the door in the pivotable manner shown and described. In this latter embodiment, the box 300 can be, as an added option, positioned on top of a vertical post 510 for purposes of mounting to accommodate a pivotable movement of the mailbox 300 about post 510.

Figure 7:
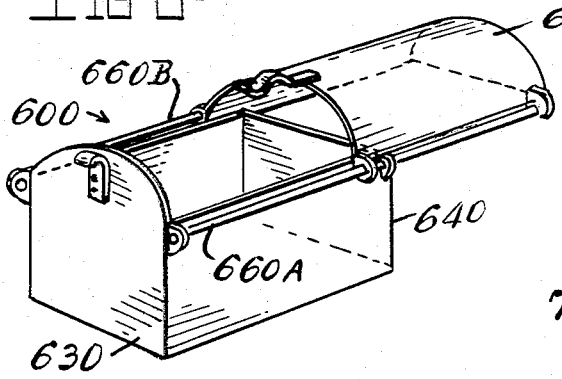
FIG. 7 is a perspective view of yet another embodiment of the subject invention.
Figure 8:
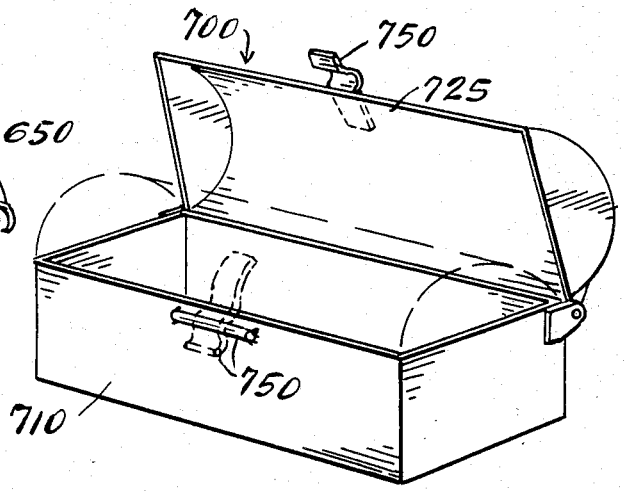
FIG. 8 is still another alternate embodiment of the invention shown in FIG. 1.

Further embodiments of the subject invention are shown in FIGS. 7 and 8. In the embodiment shown in FIG. 7, a sliding door 650 is provided, as a second possible doorway for mailbox 600 whereby the door slides along on rails 660A and 660B in the manner demonstrated in the drawings. The embodiment shown in FIG. 8 shows a mailbox in which the mailbox 700 has a door 725 which operates as a lid and opens to expose the inner chamber of the housing 710 of box 700, as shown.

While specific embodiments of the subject invention have been shown and described, it is to be stressed herein that a description of such specific embodiments shall not be construed as limiting the scope of the following claims, as other conceivable embodiments are envisioned within the scope of the invention.

I claim:

1. A box member apparatus with a hollow interior, and with a bottom undersurface, having a top and bottom portion, for receiving and holding temporarily mailing materials for eventual withdrawal of such materials from said box member, comprising:

(a) a hollow housing member having a bottom undersurface and having interior walls and a frontal end and a posterior end, said box having a frontal entranceway on the frontal end of said housing, with a pivotable doorway adapted to close or open access to the said frontal entranceway;

(b) pivotable secondary entranceway and doorway means appended to the posterior end of said housing member, said secondary doorway means having means to bias the secondary doorway means from being opened from within the interior of the housing member, and wherein said secondary doorway means has an inner wall and wherein said retaining means comprises a spring member connected between a portion of the interior wall of said housing member and a portion of the inner wall of said secondary doorway means;

(c) vertical support means connected to the bottom undersurface of said box member apparatus and adapted to hold said housing member in a position above the ground, said vertical support means having a vertical central axis;

(d) first movement means integrally connected on the bottom undersurface of said housing member for allowing movement of said housing member around the vertical central axis of said vertical support means from a first horizontal position to a horizontal position an arcuate distance of one hundred and eighty degrees around said vertical axis to a second horizontal position;

(e) second movement means interconnected to said first movement means on the bottom undersurface of said housing member to permit tilting movement of said housing member about a horizontal axis which is perpendicular to the vertical central axis of said vertical support means.

2. A hollow mailbox member, comprising:

(a) a hollow housing member having a bottom undersurface and a frontal end and a posterior end, said housing member having an entranceway on the frontal end of said housing, with a pivotable doorway adapted to close or open access to the frontal entranceway;

(b) secondary entranceway and doorway means appended to the posterior end of said housing member;

(c) pivotable means affixed to the base of said housing member;

(d) first movement means integrally connected on the bottom undersurface of said housing member for allowing movement of said housing member around the vertical central axis of said vertical support means from a first horizontal position to a horizontal position an arcuate distance of one hundred and eighty degrees around said vertical axis to a second horizontal position;

(e) second movement means interconnected to said first movement means on the bottom undersurface of said housing member to permit tilting movement of said housing member about a horizontal axis which is perpendicular to the vertical central axis of said vertical support means.

* * * * *